US008248354B2

(12) United States Patent
Shino et al.

(10) Patent No.: US 8,248,354 B2
(45) Date of Patent: Aug. 21, 2012

(54) DRIVING CIRCUIT AND IMAGE DISPLAY APPARATUS

(75) Inventors: Kenji Shino, Yokohama (JP); Yasukazu Noine, Chigasaki (JP)

(73) Assignees: Canon Kabushiki Kaisha, Tokyo (JP); Kabushiki Kaisha Toshiba, Tokyo (JP)

( * ) Notice: Subject to any disclaimer, the term of this patent is extended or adjusted under 35 U.S.C. 154(b) by 1181 days.

(21) Appl. No.: 12/057,469

(22) Filed: Mar. 28, 2008

(65) Prior Publication Data

US 2008/0246750 A1 Oct. 9, 2008

(30) Foreign Application Priority Data

Apr. 4, 2007 (JP) ..... 2007-098443

(51) Int. Cl.
*G09G 3/36* (2006.01)

(52) U.S. Cl. ..... 345/100; 345/98

(58) Field of Classification Search ..... 345/87–102, 345/208, 211
See application file for complete search history.

(56) References Cited

U.S. PATENT DOCUMENTS 6,429,836 B1 8/2002 Hansen
6,946,799 B2 9/2005 Shino et al.
2004/0217950 A1 * 11/2004 Shino et al. ..... 345/204

FOREIGN PATENT DOCUMENTS

JP 2004-233620 8/2004

* cited by examiner

*Primary Examiner* — Seokyun Moon
(74) *Attorney, Agent, or Firm* — Fitzpatrick, Cella, Harper & Scinto

(57) ABSTRACT

A driving circuit includes a plurality of output terminals to be electrically connected to scan wirings, respectively, a scan controlling unit for selecting one or plural output terminals to output a driving signal for the scan wiring from among the plurality of output terminals, and a potential correcting unit for controlling a potential of the driving signal on the basis of a difference voltage between the potential of the selected output terminal and a reference potential. In addition, a reference potential adjusting unit adjusts the reference potential in response to a current passing through the selected output terminal in order to correct a voltage drop caused by a member connected to the selected output terminal. The reference potential adjusting unit changes adjustment of the reference potential in response to the number of the selected output terminals and turns off adjustment of the reference potential in the case that the number of the selected output terminals is more than 1.

4 Claims, 10 Drawing Sheets

DRIVING CIRCUIT AND IMAGE DISPLAY APPARATUS

BACKGROUND OF THE INVENTION

1. Field of the Invention

The present invention relates to a driving circuit of a display panel and an image display apparatus.

2. Description of the Related Art

As a flat panel display, a PDP (plasma display panel) and an electron beam display apparatus using an electron-emitting device or the like have been known. This kind of image display apparatus is provided with a display panel (a matrix panel) having many display devices arranged in matrix and a driving circuit for driving a display device. Normally, a scan wiring of the display panel is electrically connected to the driving circuit by an FPC (a flexible printed circuit). In such a structure; a voltage drop of the scan wiring caused by impedance of the FPC, a wire resistance, and an on-resistance of a switch of the driving circuit or the like may present a problem. Therefore, a driving circuit disclosed in Japanese Patent Application Laid-Open No. 2004-233620 is provided with a correcting circuit for adjusting an output potential (namely, correcting a voltage drop) on the basis of a current to pass through the FPC.

As a driving system of a matrix panel, a system for driving a plurality of scan wirings at the same time (namely, a multi-line driving) has been known. The multi-line driving has advantages such as improvement of brightness of a screen and a flicker mitigation in an interlace display or the like.

In the circuit structure disclosed in JP-A No. 2004-233620, the inventors of the present invention found that correction of the voltage drop was not carried out normally when performing the multi-line driving. In the case of the multi-line driving, currents of plural lines pass through the correcting circuit and on the basis of the current values thereof, an output potential to each line is adjusted, so that excessive correction, is generated.

SUMMARY OF THE INVENTION

The present invention has been made taking the foregoing problems into consideration and an object of which is to provide an art in order to solve a disadvantage of correction of a voltage drop caused by multi-line driving.

A first aspect of the present invention may include a driving circuit for driving a display panel having a plurality of scan wirings, including: a plurality of output terminals to be electrically connected to the scan wirings, respectively; a scan controlling unit for selecting one or plural output terminals to output a driving signal for the scan wiring from among the plurality of output terminals; a potential correcting unit for controlling a potential of the driving signal on the basis of a difference voltage between the potential of the selected output terminal and a reference potential; and a reference potential, adjusting unit for adjusting the reference potential in response to a current passing through the selected output terminal in order to correct a voltage drop caused by a member connected to the selected output terminal; wherein the reference potential adjusting unit changes adjustment of the reference potential in response to the number of the selected output terminals.

A second aspect of the present invention may include an image display apparatus including a display panel having a plurality of scan wirings and the driving circuit for driving the display panel.

According to the present invention, it is possible to solve a disadvantage of correction of a voltage drop caused by multi-line driving.

Further features of the present invention will become apparent from the following description of exemplary embodiments with reference to the attached drawings.

DESCRIPTION OF THE EMBODIMENTS

With reference to the drawings, preferred embodiments of the present invention will be illustrated in detail below.

The present invention can be preferably applied to an image display apparatus having a display panel on which, many display devices are arranged in matrix (a matrix panel). As this kind of image display apparatus, a PDP (a plasma display panel) and an electron beam display apparatus or the like may be considered. In an electron beam display apparatus, a cold cathode device such as a field emission type electron-emitting device, a metal-insulator-metal type electron-emitting device, and a surface-conduction electron-emitting device or the like is preferably used as a display device. According to an embodiment to be described below, an image display apparatus using a surface-conduction electron-emitting device is taken as an example.

<Structure of Image Display Apparatus>

Figure 9A:
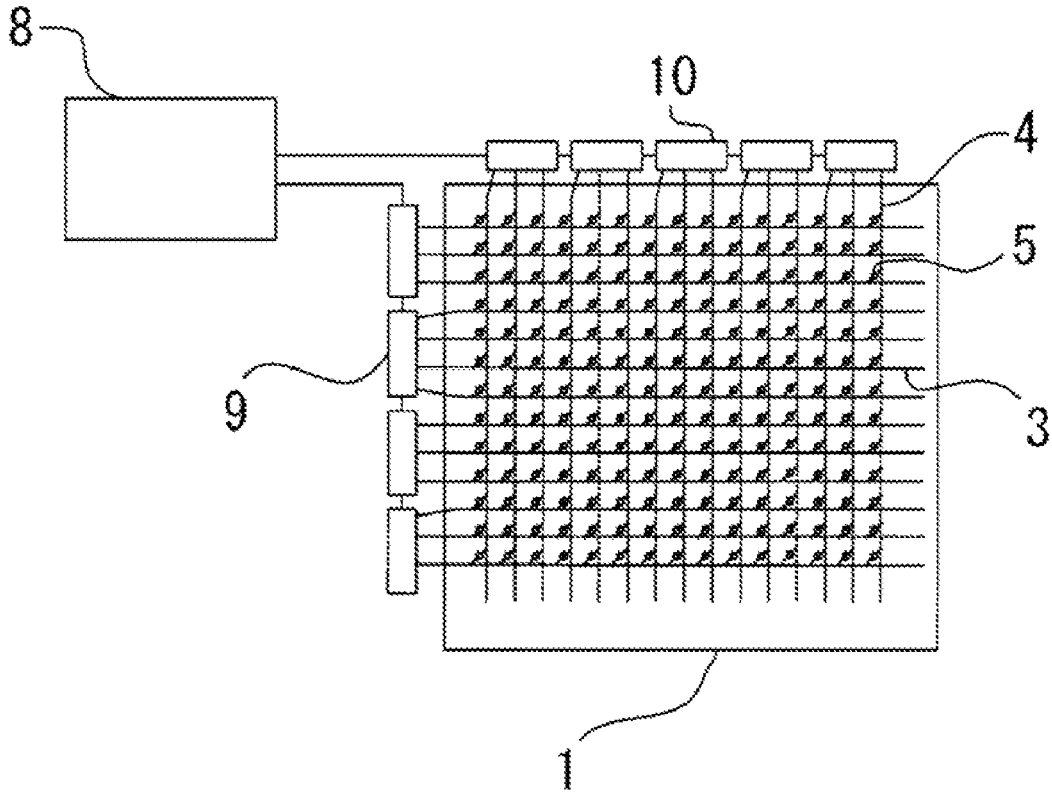
FIG. 9A is a plan view showing a structure of an image display apparatus.
Figure 9B:
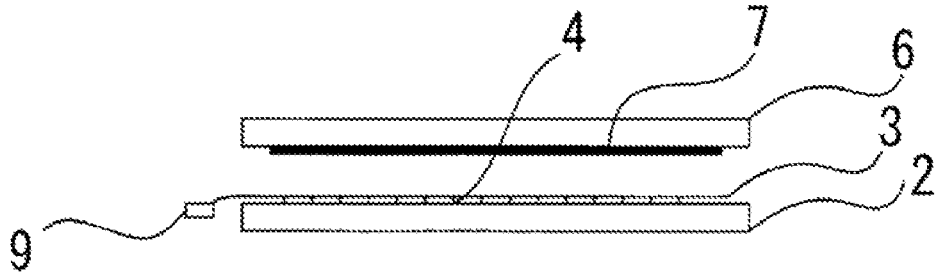
FIG. 9B is a cross sectional view showing the structure of the image display apparatus.

FIG. 9A and FIG. 9B are views showing a structure of an image display apparatus. FIG. 9A is a plan view and FIG. 9B is a cross sectional view. The image display apparatus is provided with a matrix panel (a display panel) 1, a controlling unit 8, a scan driving circuit 9, and a modulation driving circuit 10. The scan driving circuit 9 and the modulation driving circuit 10 are composed of an integrated circuit (IC), respectively. The matrix panel 1 is provided with a rear panel 2 having many electron-emitting devices 5 (electron sources) arranged thereon and a face plate 6 having a fluorescence substance 7 arranged thereon. The electron-emitting devices on the real plate 2 are simple-matrix-wired by a scan wiring 3 and a modulation wiring 4. Each scan wiring 3 is connected to an output terminal of the scan driving circuit 9 via an FPC (a flexible printed circuit) or the like. In addition, each modulation wiring 4 is connected to an output terminal of the modulation driving circuit 10 via an FPC or the like.

The controlling unit 8 controls the scan driving circuit 9 and the modulation driving circuit 10 and applies a voltage, for example, several dozens of bolts between the scan wiring 3 and the modulation wiring 4, and thereby, electrons are emitted from the electron-emitting device 5. The electrons emitted from the electron-emitting device 5 are pulled to the face plate 6, to which a high voltage in the range of several kV to several tens kV is applied, and hit the fluorescence substance 7. Thereby, light emission is obtained. By controlling the voltage to be applied between the scan wiring 3 and the modulation wiring 4 by means of the controlling unit 8, various images can be displayed.

<Scan Driving Circuit>

Figure 2:
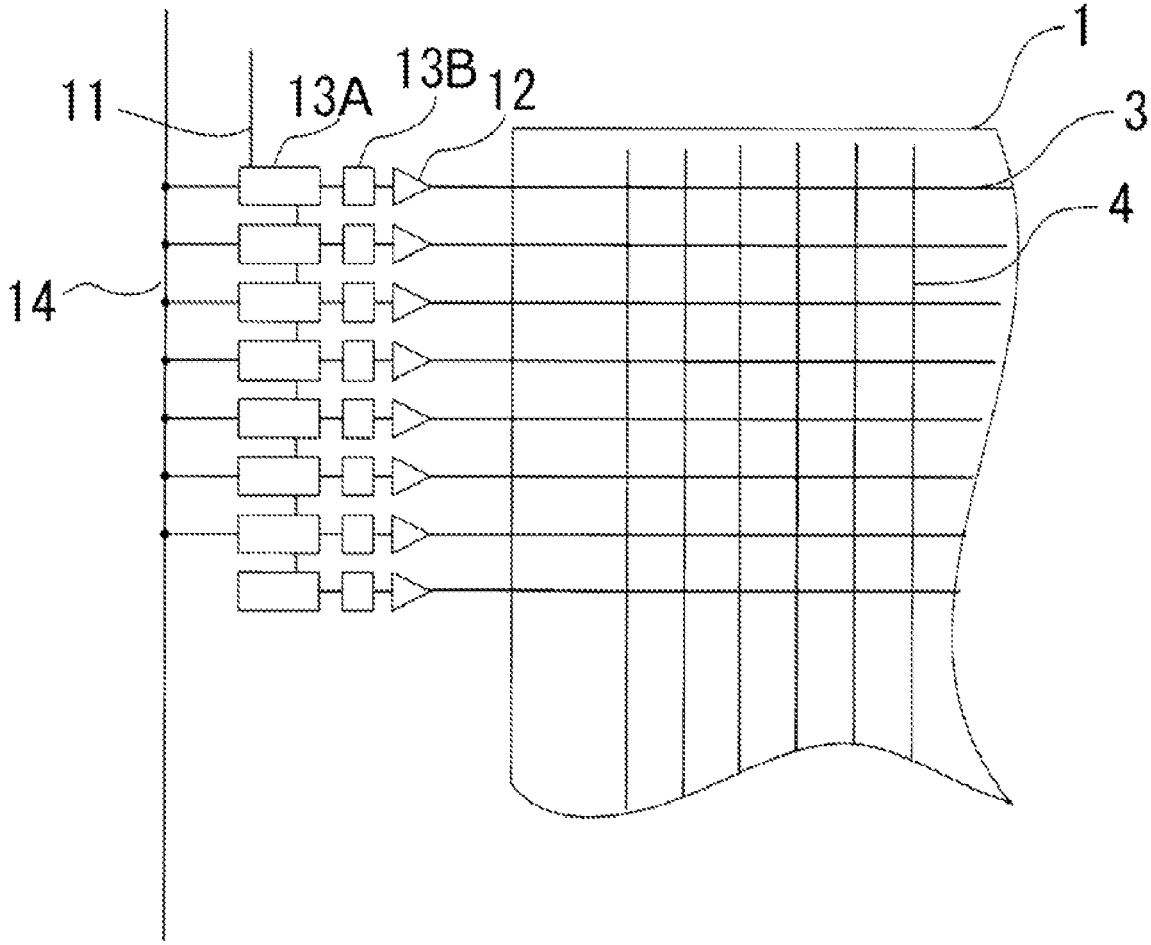
FIG. 2 is a view showing a schematic structure of a scan driving circuit.

FIG. 2 shows a schematic structure of the scan driving circuit 9. The scan driving circuit 9 is schematically configured by an output buffer 12, a shift register 13A, and a drive controlling unit 13B. The output buffer 12 is a circuit for outputting a driving signal (a scan signal) to the scan wiring 3. The output terminal (the output pad) of the output buffer 12 is electrically connected to the scan wiring 3 via an FPC or the like. The shift, register 13A is a circuit for selecting an output terminal to output a driving signal to the scan wiring 3 from among a plurality of output terminals. The drive controlling unit 13B is a circuit for converting the output of the shift register 13A into a potential for driving the output buffer 12.

According to the present embodiment, the scan driving circuit 9 may correspond to the driving circuit of the present invention, and the shift register 13A may correspond to a scan controlling unit of the present invention.

The controlling unit 3 appropriately controls shift data 11 and a shift clock 14 to be given to the shift register 13A, and thereby, various kinds of scan systems (a driving system) can be realized. For example, if the shift data is shifted for each line, progressive driving is made, and if the shift data is shifted by two lines, interlace driving is made. In addition, by devising a width of the shift data and input timing, a plurality of scan wirings 3 can be driven at the same time (multi-line driving). Hereinafter, the operational example of the scan driving circuit 9 will be illustrated.

(1) Progressive Driving

Figure 3:
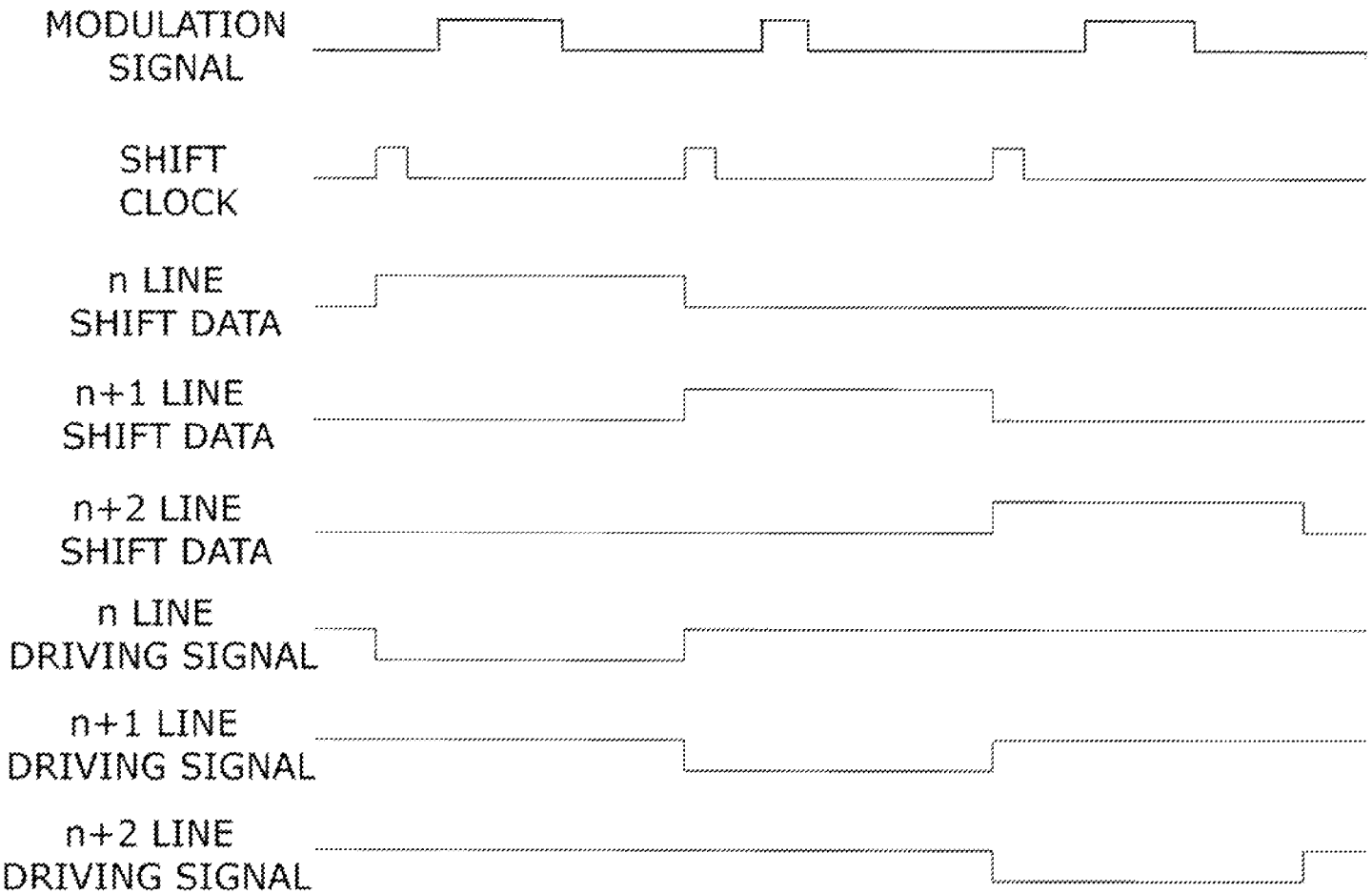
FIG. 3 is a view showing an example of a progressive driving.

FIG. 3 shows an example of progressive driving.

The shift data having a width of a horizontal period is inputted from the controlling unit 8 into a shift register. Then, by inputting a shift clock in the shift register at a cycle of a horizontal period, the shift data has been shifted in series for each horizontal period. From the shift register holding the shift data, the shift data has been outputted during a horizontal period. When the shift data is outputted from the shift register of an n line, the output buffer 12 of the n line is driven via the drive controlling unit and a driving signal of the n line is outputted. In a next horizontal period, a driving signal of an n+1 line is outputted, and in another horizontal period, a driving signal, of an n+2 line is outputted. According to the example shown in FIG. 3, a driving signal having a potential of minus several tens V is outputted to the selected scan wiring 3.

On the other hand, a modulation signal having a potential of plus several tens V is given to a modulation wiring 4 by a modulation driving circuit 10. To the electron-emitting device 5 connected to the scan wiring 3 provided with, the driving signal and the modulation wiring 4 provided with the modulation signal, a differential voltage between the driving signal and the modulation signal is applied. Thereby, electrons are emitted front the electron-emitting device 5.

(2) Interlace Driving

Figure 4:
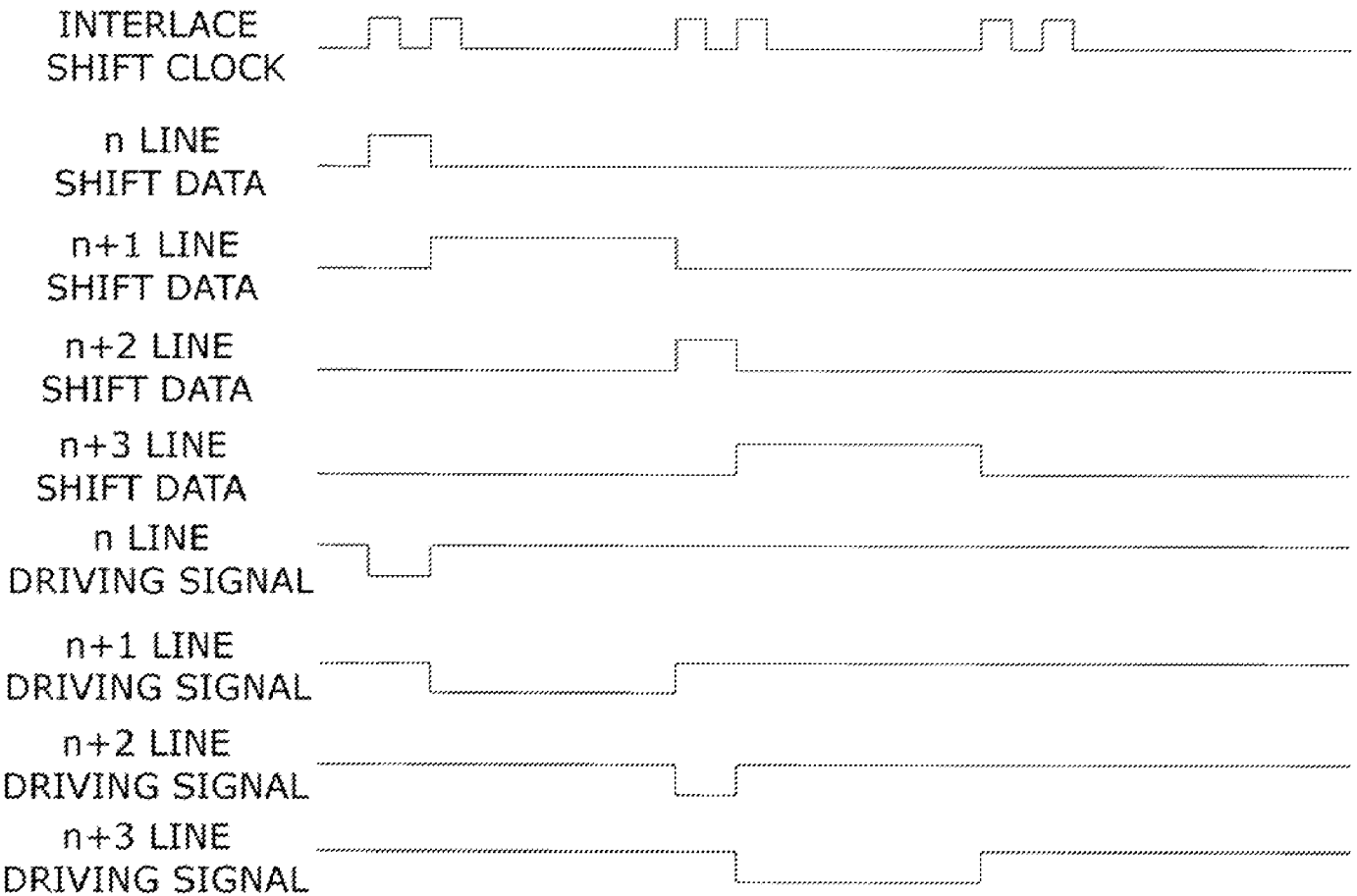
FIG. 4 is a view showing an example of interlace driving.

FIG. 4 shows an example of an interlace driving.

The driving circuit using the shift register cannot help but apply the shift data by one line. Therefore, in the case of carrying out interlace driving by such a driving circuit, a method to shift the shift data by two lines using a shift clock of two-pulse waveform is employed (refer to the specification of U.S. Pat. No. 6,429,836). According to the example of FIG. 4, an n+3 line is driven following the n+1 line.

(3) Multi-Line Driving

Figure 5:
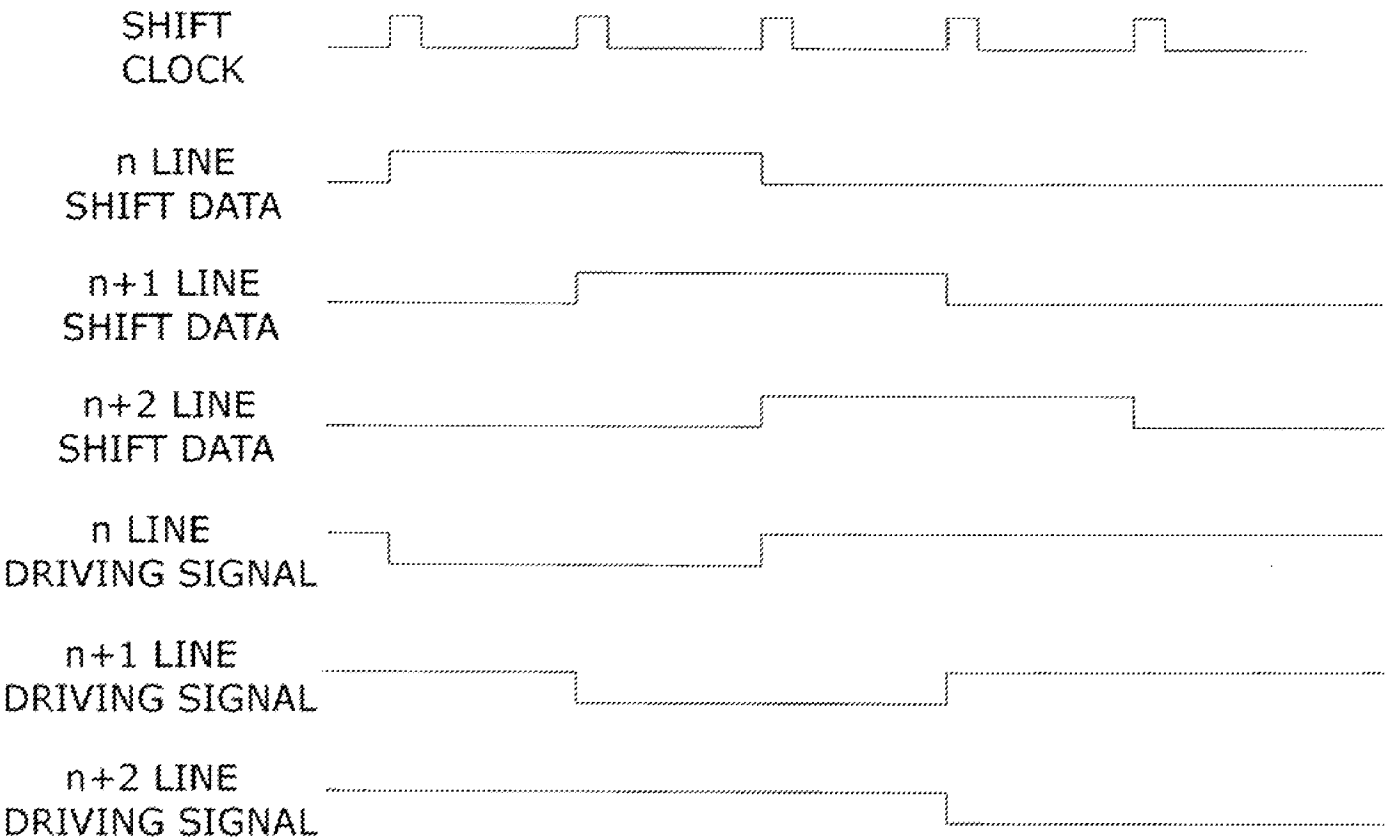
FIG. 5 is a view showing an example of two-lines driving.

FIG. 5 shows an example of two-lines driving.

In the case of two-lines driving, the shift data of a width of two horizontal periods is given to the shift register. If this shift data is shifted in series for each horizontal period, two-lines progressive driving is realized.

If the width of the shift data is made larger, it is possible to drive more adjacent lines at the same time. Alternatively, if input timing of the shift data is controlled so that a plurality of shift data is located in a vertical period, unadjacent plural lines can be driven at the same time. In addition, by devising a waveform of a shift clock, multi-line interlace driving is also made possible.

<First Constituent Example of Scan Driving Circuit>

Figure 6:
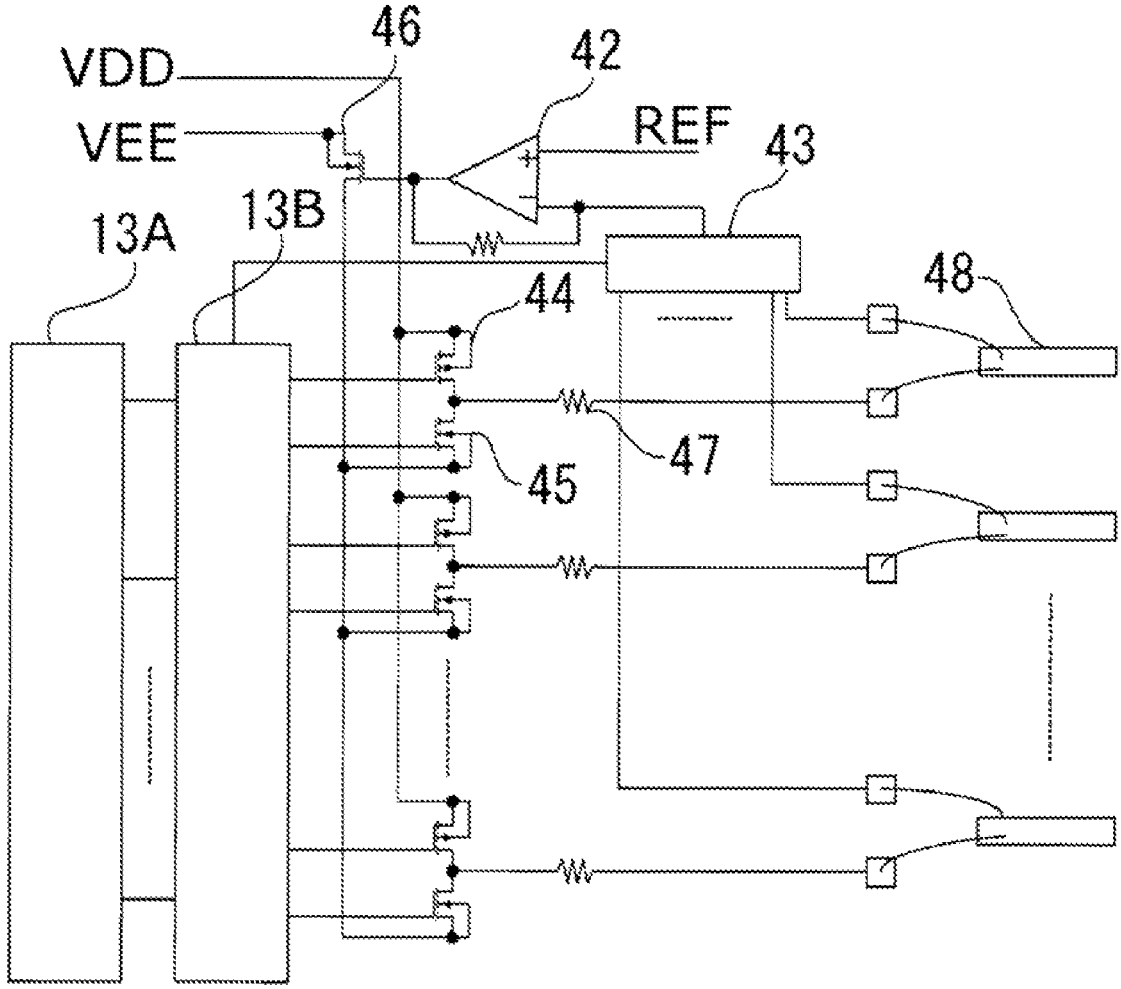
FIG. 6 shows a first constituent embodiment of the scan driving circuit.

FIG. 6 shows a first constituent example of a scan driving circuit 9.

The output buffer 12 has a non-selection switch 44 and a selection switch 45 for each line. The non-selection switch 44 is formed by a P channel MOS-FET and a source thereof is connected to an electric source of a non-selection potential VDD. The selection switch 45 is formed by an N channel MOS-FET and a source thereof is connected to an electric source of a selection potential VEE. The gates of the non-selection switch 44 and the selection switch 45 are connected to the drive controlling unit 13B and drains of them are connected to the output pad (the output terminal) 48.

With respect to a selection line (a driving line), the drive controlling unit 13B may generate a potential (the selection potential VEE+ several V (for example, 3V)) for driving the selection switch 45 on the basis of the output of the shift register 13A and may output it to the selection switch 45. Thereby, the selection switch 45 is turned on and the selection potential VEE is outputted to the scan wiring 3 via an IC internal resistance 47 and the output pad 48 or the like (this output signal is referred to as a driving signal or a scan signal).

With respect to a non-selection line (a non-driving line), the drive controlling unit 13B may generate a potential (the non-selection potential VDD− several V (for example, 3V)) for driving the non-selection switch 44 and may output it to the non-selection switch 44. Thereby, the non-selection switch 44 is turned on, and then, the non-selection potential VDD is outputted to the scan wiring 3 via the IC internal resistance 47 and the output pad 48 or the like (this output signal is referred to as a non-selection signal or a non-scan signal).

As an output buffer, the above-described simple structure only composed of switches may be available. However, in this case, a potential of the driving signal (a potential of the output pad 48 of the selection line) is displaced from the selection potential VEE since a voltage drop is generated by the on resistance of the selection switch 45 and the IC internal resistance (the resistance of the A1 wires or the like in the IC). Therefore, according to the first constituent example, a potential correcting circuit (a potential correcting unit) for controlling (correcting) the potential of the driving signal is arranged.

The potential correcting circuit is composed of an operational amplifier 42, a switch 43, and a selection potential adjusting transistor 46. The switch 43 is a circuit formed by a decoder or the like and the switch 43 switches input on the basis of a signal from the drive controlling unit 13B so that the potential of the output pad 48 of the selection line is applied to the operational amplifier 42. The input of the operational amplifier 42 is a differential voltage between the potential of the output pad 48 of the selection line and a reference potential REF, and output thereof is inputted in the gate of the selection potential adjusting transistor 46. The selection potential adjusting transistor 46 is formed by an N channel MOS-FET. The source thereof is connected to the electric source of the selection potential VEE and the drain thereof is connected to the source of the selection switch 45.

According to the potential correcting circuit having such a structure, the potential of the output pad 48 of the selection line (the potential of the driving signal) is feedback-controlled so as to approach the reference potential REF, so that a voltage drop inside of the IC is preferably compensated.

<Second Constituent Example of Scan Driving Circuit>

As shown in FIG. 4. In the case that the interlace driving is realized by devising the shift clock, a driving signal is also instantaneously outputted to a skipped line (in the example of FIG. 4, a n line and a n+2 line or the like). Turning on and off for a very short time as this, distortion of waveform (ringing) is generated, so that it is feared that a display quality is influenced.

Figure 7:
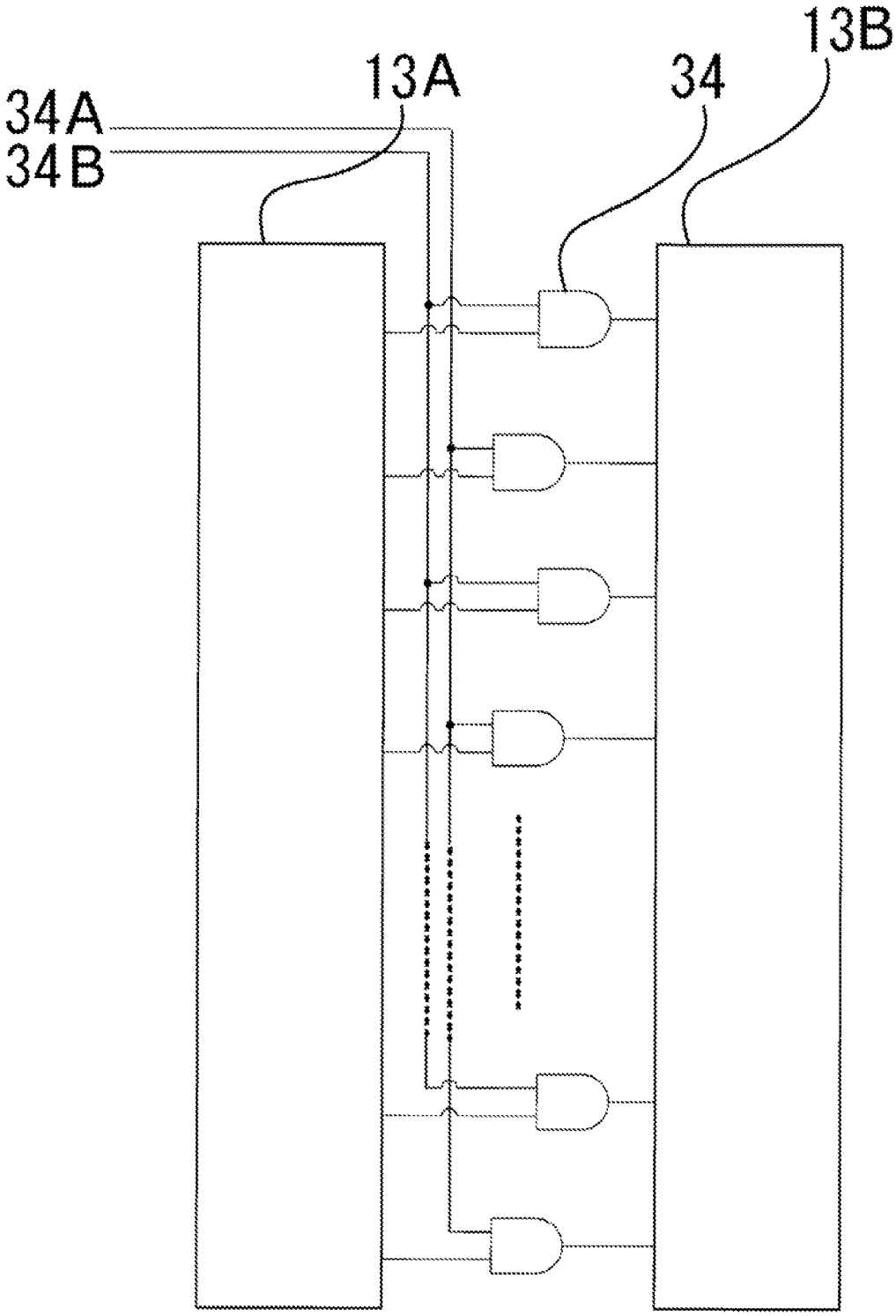
FIG. 7 shows a second constituent embodiment of the scan driving circuit.

The second constituent example, shown in FIG. 7 is a constituent example in order to solve the above-described problem. According to this second constituent example, an AND gate 34 for masking the shift register output is arranged between the shift register 13A and the drive controlling unit 133 of each line. One input of the AND gate 34 for even-numbered lines is connected to an enable signal line 34A for even-numbered lines and other input is connected to output of the shift register 13A. In addition, one input of the AND gate 34 for odd-numbered lines is connected to an enable signal line 34B for odd-numbered lines and other input is connected to output of the shift register 13A.

Upon driving of the even-numbered lines, an enable signal (HI) is applied to the enable signal line 34A for even-numbered lines, and a disable signal (LO) is applied to the enable signal line 34B for odd-numbered lines. Thereby, the shift register output for odd-numbered lines is masked, so that the drive controlling unit 13B for odd-numbered lines is not operated. On the contrary, upon driving of the odd-numbered lines, the disable signal (LO) is applied to the enable signal line 34A for even-numbered lines, and the enable signal (HI) is applied to the enable signal line 34B for odd-numbered lines. Thereby, the shift register output for even-numbered lines is masked. According to the above-mentioned structures, driving of the skipped lines is prevented.

<Third Constituent Example of Scan Driving Circuit>

According to a potential correcting circuit of the first, constituent example, by feed-backing the potential of the output pad 48, the voltage drop inside of the IC is corrected. However, the voltage drop is generated even in a member to be connected to the output pad 48 such as an FPC (some may have, impedance of several hundreds mΩ), so that correction of the first constituent example is not sufficient.

If impedance of the member such, as an FPC connected to the output pad 48 has been known in advance, the voltage drop amount thereof can be estimated from the current amount flowing through there. In other words, if the current amount flowing from, the output pad 48 into the IC internal resistance 47, the selection switch 45, and the selection potential adjusting transistor 46 is known, it is possible to correct the voltage drop of the FPC or the like.

Figure 8:
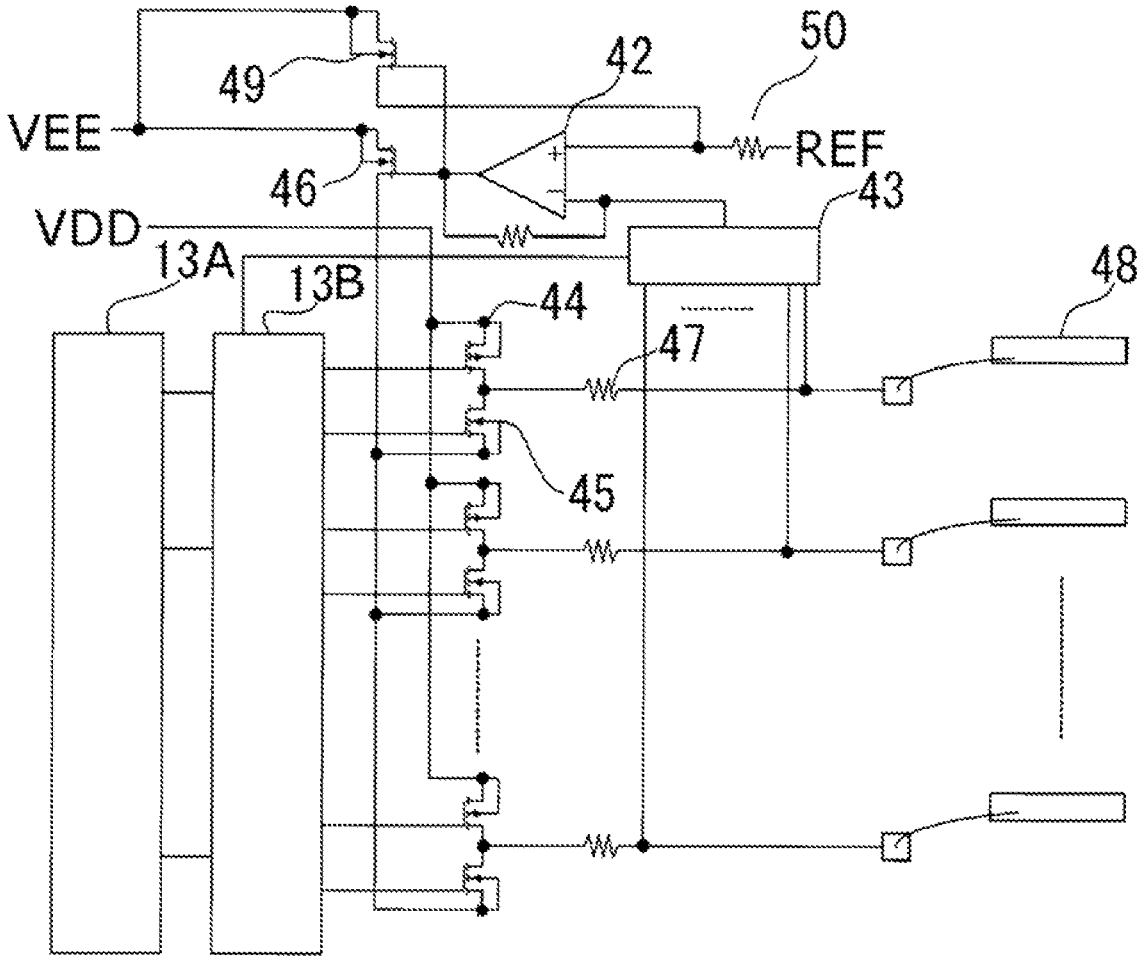
FIG. 8 shows a third constituent embodiment of the scan driving circuit.

In the third, constituent example of FIG. 8, a reference potential adjusting circuit (a reference potential adjusting unit) is added to the circuit according to the first constituent example. This reference potential adjusting circuit is a circuit for adjusting the reference potential REF in response to the current flowing through the output pad 48 in order to correct the voltage drop caused by the member such as an FPC connected to the output pad 48.

The reference potential adjusting circuit is formed, by a current mirroring transistor 49 and an adjusting resistance 50. The current mirroring transistor 49 is formed by an N channel MOS-FET. Then, a source thereof is connected to an electric source of the selection potential VEE and a gate thereof is connected to output of the operational amplifier 42. The current mirroring transistor 49 forms a current mirror circuit with the selection potential adjusting transistor 46. A cell size of the current mirroring transistor 49 is set at 1/500 of the selection potential adjusting transistor 46, for example. The adjusting resistance 50 is arranged between an electric source (a source) of the reference potential REF and the reference potential input of the operational amplifier 42, and the drain of the current mirroring transistor 49 is connected between the reference potential input of the operational amplifier 42 and the adjusting resistance 50. The resistance value of the adjusting resistance 50 is set on the basis of the impedance of the member such as an FPC.

According to the above-described configuration, if certain line is driven, a current that is 1/500 of the drain current of the selection potential adjusting transistor 46 (namely, a mirror current) flows through the drain of the current mirroring transistor 49. When this mirror current flows through the adjusting resistance 50, the reference potential REF is adjusted. Then, when the adjusted reference potential REF is inputted in the operational amplifier 42, the voltage drop caused by external members of the IC such as an FPC is also corrected.

<Excessive Correction upon Multi-line Driving>

If the multi-line driving is carried out in the scan driving circuit according to the third constituent example, a defect is generated in a correction of a voltage drop. For example, in the case of driving two lines at the same time, the current for two lines flows through the drain of the selection potential adjusting transistor 46, so that the adjustment amount of the reference potential REF is made about two times. However, the amount of the voltage drop of each line is the same as that upon the single line driving, so that the correction becomes excessive.

In order to solve such an excessive correction upon the multi-line driving, the reference potential adjusting circuit may change adjustment of the reference potential REF in response to the number of lines (the number of the driven lines) to be driven at the same time. For example, a simple structure may be available such that adjustment is turned off in the case of the multi-line driving. Alternatively, the resistance value of the adjusting resistance 50 is changed in response to the number of the driven lines so that the adjusted reference potential is made substantially constant not depending on the number of the driven lines. As the structure to change the resistance value of the adjusting resistance 50, the structure to change the resistance that is used for adjustment in response to the number of the driven lines between a plurality of resistances having different resistance values and the structure using a variable resistance or the like may be employed. Hereinafter, the specific embodiment (s) are illustrated.

<First Embodiment for Solving Excessive Correction>

Figure 1:
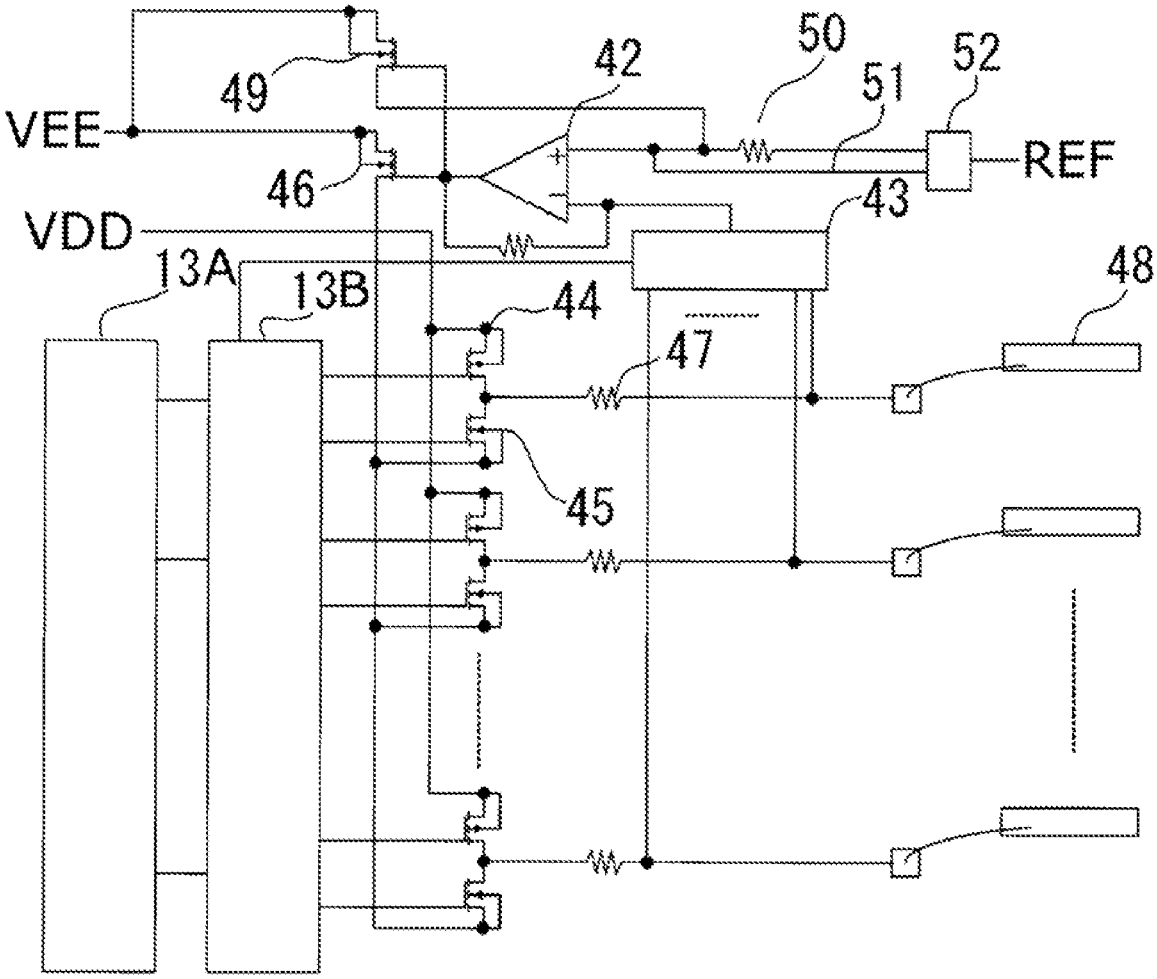
FIG. 1 is a view showing a first embodiment, in order to solve excessive correction, upon a multi-line driving.

FIG. 1 shows a first embodiment for solving an excessive correction upon multi-line driving. Hereinafter, the constituent part different from the first to third constituent examples will be mainly explained.

A reference potential adjusting circuit according to a first embodiment has a bypass line 51 and a resistance switch 52.

The bypass line 51 is a wiring for short-circuiting a source of a reference potential REF and a reference potential input of the operational amplifier 42. A resistance switch 52 is a switch for switching the adjusting resistance 50 and the bypass line 51 corresponding to the number of the driven lines. A resistance switch 52 is provided with an indication value corresponding to the number of the driven lines from the controlling unit 8 or the drive controlling unit 13B.

In the case that the number of the driven lines is 1 (in the case of a single line driving), the resistance switch 52 may select the adjusting resistance 50. Thereby, the reference potential REF is adjusted and a voltage drop caused by the FPC or the like is corrected.

In the case that the number of the driven lines is more than 1 (in the case of a multi-line driving), the resistance switch 52 may select the bypass line 51. Adjustment of the reference potential REF is turned off. Thereby, it is possible to prevent the excessive correction upon the multi-line driving.

<Second Embodiment for Solving Excessive Correction>

Figure 10:
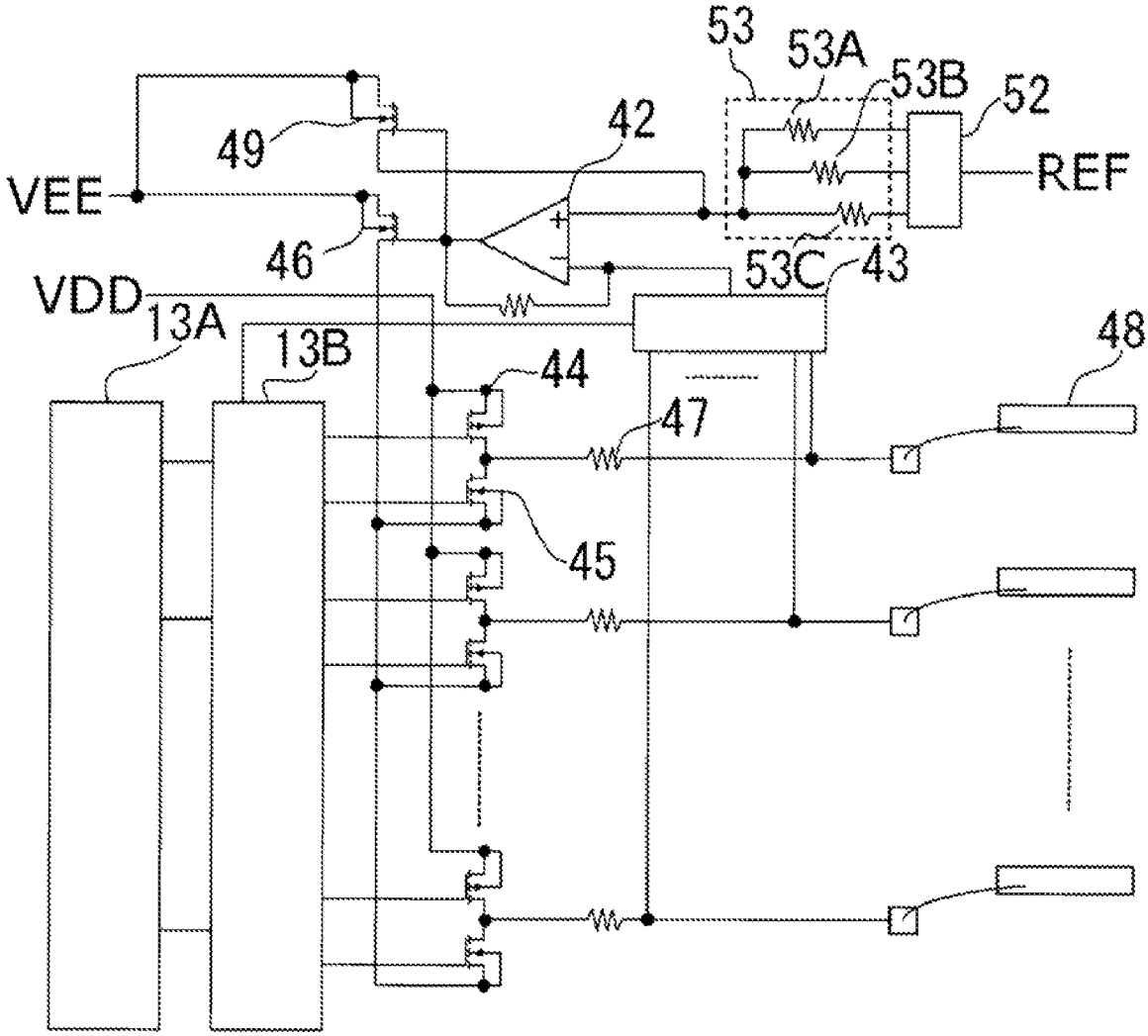
FIG. 10 is a view showing a second embodiment in order to solve excessive correction upon a multi-line driving.

FIG. 10 shows a second embodiment for solving excessive correction upon a multi-line driving.

An adjusting resistance 53 according to the second embodiment has plural resistances 53A, 333, and 53C having different resistance values. Then, the resistance switch 52 may select the resistance 53A in the case that the number of the driven lines is 1, may select the resistance 53B in the case that the number of the driven lines is 2, and may select the resistance 53C in the case that, the number of the driven lines is 3. Thereby, it is possible to align the adjustment amount of the reference potential not depending on the number of the driven lines, so that the voltage drop caused by the FPC or the like can be corrected well even in the case of the multi-line driving. Further, the number of resistance is not limited to three and in response to the variation of the multi-line driving, the adjusting resistance 53 may be appropriately deformed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-098443, filed on Apr. 4, 2007, which is hereby incorporated by reference herein in its entirety.

What is claimed is:

1. A driving circuit for driving a display panel having a plurality of scan wirings, comprising:

a plurality of output terminals to be electrically connected to the scan wirings, respectively;

a scan controlling unit for selecting one or plural output terminals to output a driving signal for the scan wiring from among the plurality of output terminals;

a potential correcting unit for controlling a potential of the driving signal on the basis of a difference voltage between the potential of the selected output terminal and a reference potential; and a reference potential adjusting unit for adjusting the reference potential in response to a current passing through the selected output terminal in order to correct a voltage drop caused by a member connected to the selected output terminal;

wherein the reference potential adjusting unit changes adjustment of the reference potential in response to the number of the selected output terminals, and wherein the reference potential adjusting unit turns off adjustment of the reference potential in the case that the number of the selected output terminals is more than 1.

2. A driving circuit according to claim 1, wherein the reference potential adjusting unit has an adjusting resistance between a source of the reference potential and the potential correcting unit and adjust the reference potential to be applied to the potential correcting unit by flowing a current corresponding to a current flowing through the selected output terminal into the adjusting resistance.

3. A driving circuit for driving a display panel having a plurality of scan wirings, comprising:

a plurality of output terminals to be electrically connected to the scan wirings, respectively;

a scan controlling unit for selecting one or plural output terminals to output a driving signal for the scan wiring from among the plurality of output terminals;

a potential correcting unit for controlling a potential of the driving signal on the basis of a difference voltage between the potential of the selected output terminal and a reference potential; and a reference potential adjusting unit for adjusting the reference potential in response to a current passing through the selected output terminal in order to correct a voltage drop caused by a member connected to the selected output terminal;

wherein the reference potential adjusting unit changes adjustment of the reference potential in response to the number of the selected output terminals, wherein the reference potential adjusting unit has an adjusting resistance between a source of the reference potential and the potential correcting unit and adjusts the reference potential to be applied to the potential correcting unit by flowing a current corresponding to a current flowing through the selected output terminal into the adjusting resistance, and wherein the reference potential adjusting unit bypasses the adjusting resistance and applies the reference potential to the potential correcting unit in the case that the number of the selected output terminals is more than 1.

4. A driving circuit for driving a display panel having a plurality of scan wirings, comprising:

a plurality of output terminals to be electrically connected to the scan wirings, respectively;

a scan controlling unit for selecting one or plural output terminals to output a driving signal for the scan wiring from among the plurality of output terminals;

a potential correcting unit for controlling a potential of the driving signal on the basis of a difference voltage between the potential of the selected output terminal and a reference potential; and a reference potential adjusting unit for adjusting the reference potential in response to a current passing through the selected output terminal in order to correct a voltage drop caused by a member connected to the selected output terminal;

wherein the reference potential adjusting unit changes adjustment of the reference potential in response to the number of the selected output terminals, wherein the reference potential adjusting unit changes a resistance value of the adjusting resistance in response to the number of the selected output terminals, and wherein the adjusting resistance has a plurality of resistances having different resistance values; and the reference potential adjusting unit switches a resistance used for adjustment in response to the number of the selected output terminals.

* * * * *